United States Patent [19]

Schrock

[11] 4,207,860

[45] Jun. 17, 1980

[54] WOOD-COAL HEATING UNIT

[76] Inventor: Andrew J. Schrock, Rt. #1, Box 68A, Shiloh, Ohio 44878

[21] Appl. No.: 872,232

[22] Filed: Jan. 25, 1978

[51] Int. Cl.[2] ..... F24C 1/14

[52] U.S. Cl. ..... 126/77; 126/60

[58] Field of Search ..... 126/77, 76, 75, 117, 126/69, 83, 60, 61, 104, 190, 15

[56] References Cited

U.S. PATENT DOCUMENTS

| | | | |
|---|---|---|---|
| 698,799 | 4/1902 | Cahoone | 126/15 R |
| 837,456 | 12/1906 | Ericson | 126/75 |
| 918,823 | 5/1909 | Cahoone | 126/77 |
| 974,290 | 11/1910 | Merritt | 126/77 |
| 1,339,039 | 5/1920 | Parr | 126/77 |
| 1,409,679 | 3/1922 | Dean | 126/77 |
| 1,718,158 | 6/1929 | Lange | 126/77 |
| 1,957,544 | 5/1934 | Klemme | 126/77 |
| 2,345,519 | 3/1944 | Wingert | 126/77 |
| 2,948,276 | 8/1960 | Harding | 126/77 |
| 3,171,399 | 3/1965 | Kirgan | 126/69 |
| 3,237,622 | 3/1966 | Best | 126/77 |
| 4,102,318 | 7/1978 | Runquist | 126/76 |
| 4,136,662 | 1/1979 | Willson | 126/77 |

OTHER PUBLICATIONS

*Thermo-Control Stoves,* brochure by National Stove Works, Coldeskill, N.Y. Stoves manufactured since 1975.

*Primary Examiner*—Carroll B. Dority, Jr.
*Assistant Examiner*—Lee E. Barrett

[57] ABSTRACT

A wood and coal fired heating unit, comprising a magazine wherein is incorporated a preheating draft manifold, supplying all primary and secondary drafts to the combustion zone and secondary combustion chamber. Within the fuel combustion chamber a baffle, the same comprising a wall between said combustion zone and said secondary combustion chamber. The secondary combustion chamber is housed within the heater fuel combustion chamber for maximum temperature operation for completing the combustion of the unburned volatile gases leaving the primary combustion zone. With indirect primary draft in the primary combustion zone, in combination with the secondary combustion system, the invention being capable of sufficient combustion of the fuels considerably retarding formation of creosote.

5 Claims, 3 Drawing Figures

WOOD-COAL HEATING UNIT

BACKGROUND OF THE INVENTION

1. Field of the Invention

The present invention relates generally to wood and coal heating units and more particularly concerns heating units, their means and method of combustion. A base burner with preheated and indirect primary draft in the primary combustion zone. Further comprising a secondary combustion chamber and means for completing combustion of the unburned volatile gases leaving the primary combustion zone.

2. Description of Prior Art

The prior art of wood and coal fired heating units (many called air-tights) their method and means of combustion are unable to prevent the condensation of pyroligneous acid or creosote formation in the exhausting flue. Various designs of prior art have been created to try and overcome the creosote problem and obtain more complete combustion. Several designs of prior art are the downdraft, base burners with secondary combustion chamber, preheating the draft and magnetic snap action draft control. But in practice with their unbalanced design the desired results were not achieved. The obvious solution in the downdraft system was to reverse the direction of the draft so that the volatile gases were carried downward and burned in the heat of the coals. The operation of this design was difficult and unpleasant backpuffing occurred unless the chimney was hot and drawing well. Several systems on the design of the base burner and secondary combustion chamber have attempted to obtain more complete combustion and overcome the creosote problem. These systems using direct primary draft and inadequately heated secondary combustion chamber, are also notorious producers of creosote formation. Another attempt was made to overcome the creosote problem, using the same mentioned system in combination with the use of a magnetic snap action draft control, but the desired results were not acheived.

The prior art of preheating of the primary draft was desireable, but these systems also incorporated a direct primary draft through the charge of fuel. Such systems with no or improperly designed secondary combustion chamber, are also notorious producers of creosote formation. Several designs of prior art, using secondary combustion chambers have them built where the greatest portion is on the outside of the heater magazine. At times such arrangement is also unsatisfactory, because of the fact that the secondary combustion chamber operates under a too low temperature or under the ignition point of the volatile gases, especially at a time when the temperature should be at its highest, therefor my invention houses the secondary combustion chamber all inside of the heater the body, with a flattended design, in such a way that a greater portion is in proximity of the primary combustion zone, resulting the secondary combustion to operate at a much higher temperature and at a longer length of time in the combustion cycle, resulting in more complete combustion of the volatile gases.

It has been accepted practice in combustion processes to supply the primary draft direct through the charge of fuel. At times in such an arrangement, the rate of combustion is difficult to regulate and can only be regulated with closing down of the primary draft, resulting a system duplicating wood tar distillation. With such systems being "air tight" there is a stage in combustion, where it is unusually difficult to keep the primary volatile gases in balance with the capacity of the secondary combustion cycle, especially with units being air-tight. Our design (with draft in closed position) will permit a small amount of air into the unit, encourging more of a balanced combustion and less creosote formation, however the unit being sufficiently air tight to have full control of combustion. It is to be noted that this is much easier accomplished, with our use of indirect primary draft.

It should be understood that deposition of the unburned gases as creosote formation comes mostly when wood is used as fuel. The creosote deposits in flues or chimney can become a nuisance and creosote an inflameable substance can become very dangerious, esecially if the creosote ignites. What is needed then is a heating unit comprising a method and means to adequately burn off the volatile gases considerably retarding the creosote problem to its maximum. A unit easy to control and capable of a very even heat output, plus the utmost in safety. The present invention simultaneously achieves all of these results.

SUMMARY OF THE INVENTION

The present invention was conceived to accomplish a method capable for obtaining more complete combustion, to burn off the volatile gases to a point of preventing the condensation of pyroligneous acid or creosote formation in exhausting flues. The present invention is incorporated into wood and coal fired heating units, but could be employed in many other types of heating and combustion systems.

The present invention comprising a heater duct combustion chamber, futher consisting a lower primary combustion and upper secondary combustion zone, plus a baffle or wall in conjunction of the manifold, forming a secondary combustion chamber. Thermostatically controlled draft enters the manifold at its top section and is distributed in both directions, providing passage for all primary air drafts, and also secondary draft means to both the secondary combustion zone and secondary combustion chamber. A manifold of such contruction also provides for A duct for preheating both primary and secondary drafts supplying air through a plurality of outlet ports, aiding in more complete combustion of the volatile gases. The preheated primary air enters the primary combustion zone through the dual primary outlet ports. Preheated draft is desirable, since it helps maintain a higher temperature through-out the combustion process, enhancing the energy-liberating combustion reactions to occur.

Means to recycle a certain percentage of the heat in the exhausting gases of the secondary combustion chamber in preheating of the primary and secondary drafts, enhancing a lower exhaust flue temperature plus saved thermal energy.

A desirable effect on the primary draft for controlling the rate of combustion. Since air expands when heated and free hot air rises, the same effect is encountered in the vertical channels of the manifold enhancing a reduction effect in the velocity of the primary draft, as the combustion temperature rises and when the combustion temperature lowers so will the velocity of the primary draft increase. This desireable effect in conjunction with the thermostat control provide a balanced flow of draft, and with this balanced flow of draft indirect to the charge of fuel, result a system of very even heat output.

A wall of the both end sections and ceiling of the secondary combustion chamber, serving as a heat exchanger for preheating of all primary and secondary drafts.

A baffle is mounted over the edge of the manifold in such a way that it forms a wall between the primary - secondary combustion zone and secondary combustion chamber. The manifold and baffle is mounted inside and to one side of a generally rectangular fuel combustion chamber. The primary draft is supplied indirect to the charge of fuel, enhancing a more balanced expulsion of the volatile gases. A limited amount of the volatiles may give rise to the secondary combustion zone, where combustion is continued. The partially combusted gases, move by natural draft downward and in proximity of the hot coals as they enter the secondary combustion chamber. The dual primary air ports can also supply preheated air to the burning gases as they enter the secondary combustion chamber aiding to their combustion. The hot burning gases entered the secondary combustion chamber are further mixed with preheated secondary air as they are separated below a shelf and reunited above the shelf, forming a turbulence encourageing sufficient combustion before exiting out the flue. In this system the rate of combustion and efficiency is largely responsive to the capability of the stack through natural and thermally induced draft, limited by the charge of fuel and called temperature.

The novel features which are beleived to be characteristic of the invention is the manifold and its function, indirect primary draft and special designed secondary combustion chamber, together with its organization and method of operation. Further objects and and advantages thereof will be better understood from the following discription to be considered in connection with the accompanying drawings in which a presently preferred embodiment of the invention is illustrated. The invention will be discussed in reference as installed in a rectangular chamber of wood and coal heating units and it is to be expressly understood that the drawings are for the purpose of illustration and description only, and it is not intended as a definition of the limits of the invention.

DESCRIPTION OF THE PREFERRED EMBODIMENT

Figure 1:
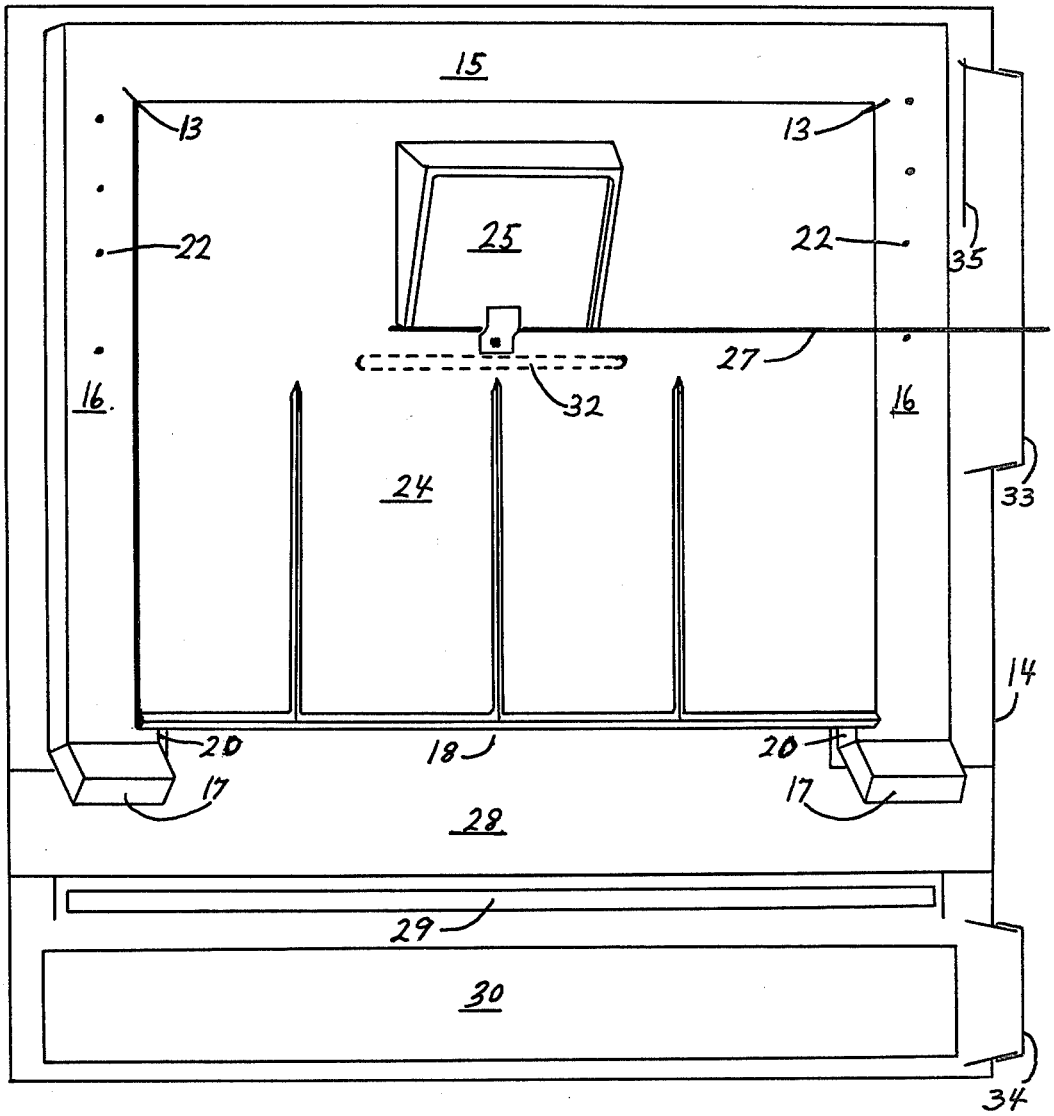
FIG. 1 is a cross sectional view of the present invention as incorporated into the back side of a rectangular body and side shown facing toward the combustion zone.
Figure 2:
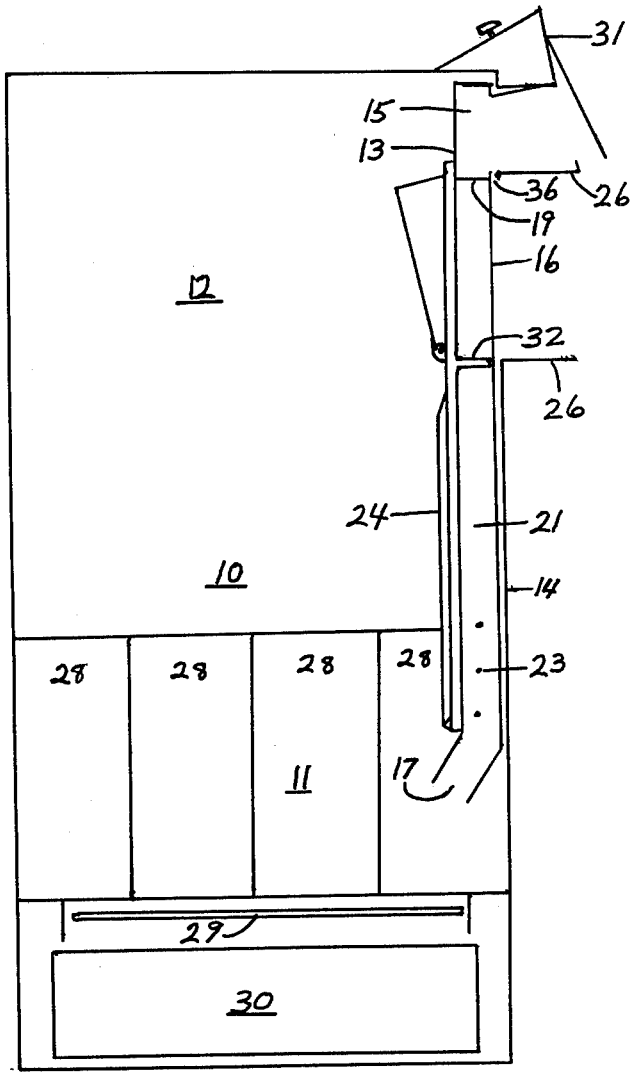
FIG. 2 is a split end sectional view of my invention and primary - secondary combustion zones.
Figure 3:
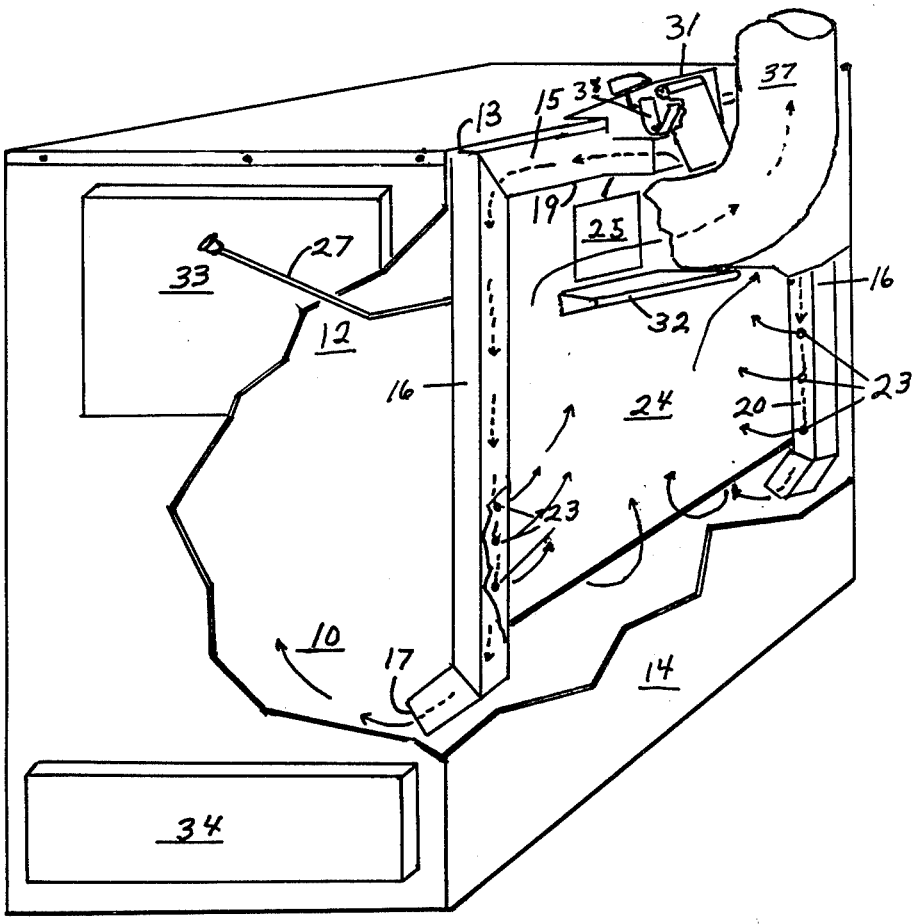
FIG. 3 is a perspective view of the preferred embodiment of the invention with a portion broken away. The arrows represent flow patterns essential to the invention.

Referring now to FIG. 1 FIG. 2 and FIG. 3 of the drawings, numeral 10 refers to the combustion zone having a lower primary 11 and upper secondary combustion zone 12. The present invention comprises of a draft manifold 13 with a horizontal section 15 communicating with two vertical sections 16 downward to a desired distance and point above the grates 29 and being mounted on the inside and to one side of the heater chamber 14. The bottom ends of the two vertical sections 16 provide the dual primary outlet ports 17 which are in proximity of the inlet aperture 18 of the secondary combustion chamber 21. The horizontal section 15 of the manifold provide the purpose as the ceiling 19 and the two vertical sections 16 of the manifold provide end walls 20 of the secondary combustion chamber 21. The manifold 13 readily provide means for preheating and distributing secondary air through a purality of outlet ports 22 and 23 both to the secondary combustion zone 12 and to the secondary combustion chamber 21. A ribbed cast iron baffle 24 is mounted over the edge of the manifold 13 forming a partition between the combustion zone 10 and the secondary combustion chamber 21.

The cast iron iron baffle 24 is ribbed for added renforcement and employs a bypass door 25 which is opened when refueling. creating a direct draft from the combustion zone 12 to the flue outlet 26 bypassing the secondary combustion chamber 21, for the purpose of eliminating the possible back smoking problem when refueling. A operating lever of the bypass door 25 is connected by means of a rod 27 and designed in front of the refueling door 33 forcing the bypass door 25 to be opened before the refueling door 33 can be opened. Cast in the same baffle plate 24 is a shelf 32 inside of the secondary combustion chamber 21 and right under the bypass door 25 and flue outlet collar 26 forcing the combusting gases along the walls of the manifold 13 before exiting out the flue outlet collar 26. The secondary combustion chamber 21 with a flattened design is better understood by the drawings, having a depth same as the depth of the manifold 13 and the width being the distance between the vertical sections 16 of the manifold 13 and the height being toward the bottom edge of the vertical sections 16 of the manifold 13 to the bottom edge of the horizontal section 15 of the manifold 13, the area inside of the secondary combustion chamber 21 being of ample area for secondary combustion to occur.

The primary combustion zone 11 is lined with refractory fire brick enhancing a higher temperature within the combustion zone 10 and longer heater life. A pair of rocking grates 29 are provided at the bottom of the primary combustion zone 11 to permit convenient removal of noncombustable ash from the primary combustion zone 11. As ash collector pan 30 is provided under the grates 29 for conveient ash removal from the heater. The sealing surface of the refueling 33 and ash removal door 34 are designed on a slight taper whereby when the doors 33 and 34 are in a closed position, being substantially air tight eliminating the need for failure-prone asbestos gaskets. A hinged flap or smoke screen 35 is used over the refueling door 33 opening preventing back-smoke when refueling. Mounted over the top back edge of the heater 14 is a bi-metal 38 thermostatic control 31, which controls both the primary and secondary drafts in the manifold 13.

The method of combustion and purpose of the various elements of the invention discribed may now be understood considering the following. First a fuel such as wood is placed in the combustion zone 10 and with the thermostat 31 and the bypass door 25 in open position, a fire is set and left in this position till we have a established fire bed. After the fire is established, the bypass door 25 is closed and will be opened only when refueling. Room air enters the thermostate 31 vent and into the horizontal section 15 of the manifold 13 and is distributed in both directions, drawing heat from the burning gases in the combustion zone 10 and the secondary combustion chamber 21.

The draft flows from the horizontal section 15 of the manifold 13 into the two vertical sections 16 of the manifold 13 and under normal operations reaches upward to 1200° F. as it flows into the primary combustion zone through the dual primary air ports 17. With the primary draft indirect to the charge of fuel, it has been observed that combustion usually takes place in from each end. Some of the volatile gases being more thoroughly oxidized with the high aid of the temperature primary air may give rise to the secondary combustion zone 12, where preheated secondary air, through a purality of inlet ports 22 supply oxygen to the volatile gases for more oxidizing or burning. The partly combusted gases are drawn downward and in proximity with the bed of coals before entering the secondary combustion chamber 21. The dual primary air ports 17 being in proximity of the aperture 18 of the secondary combustion chamber 21, can also supply oxygen to the entering and burning gases further aiding to their combustion. The partly combusted and burning gases now entered the lower region of the secondary combustion chamber 21 are again supplied with preheated secondary air through a plurality of secondary air ports 23 along the vertical sections 16 of the manifold 13. On account of the shelf 32 in the secondary combustion chamber 21 whereby the combusting gases are split and forced along the manifold 13 promoting a turbulence in the burning gases aiding to better oxidizing and their more complete combustion. It has been observed that the temperature inside the secondary combustion chamber 21 reaches as high as 1200°–1350° F., well above the ignition point of the volatile gases. The gases under most circumstances are sufficiently they exit out the flue outlet collar 26 where again a plurality of air ports 36 supply preheated air for more burning or just mixing with the flue gases, thereby preventing the condensation of pyroligneous acid in the exhausting flues. The draft control 31 cannot shut down completely air tight enhancing both stability and providing limited air flow to the secondary combustion chamber 21 from the inlet ports 23 and 36 even when the unit is in shut down position. As the room temperature is reached the bi-metal 38 thermostat control 31 closes and the primary draft and fire naturally die down and the temperature falls causing the gases in the combustion chamber 10 to contract and a limited amount of air can be drawn into the primary combustion chamber 11 keeping the fire barely alive until heat is called for once again and the bi-metal 38 control 31 opens permiting flow of primary and secondary drafts. The bi-metal 38 control 31 senses both the incoming air and stove temperature, plus also the flue temperature by means of stack pipe 37 exstending in proximity of the bi-metal 38 control unit 31. This latter effect of stack temperature sensing is accomblished by installing first a elbow turned up into the outlet collar 26. The bi-metal 38 control 31 in conjunction of the counter draft effect in the vertical sections 16 of the manifold 13 provide a balanced and steady stream of draft, resulting a heater with a very even heat output.

It is to be noted that there is no draft under the grates 29 passing through the grates 29 and ash bed. The results is the combustable ashes burn up so much finer because they are not cooled from the incoming cold air passing up through them, saving energy from the fuels, plus a more efficient unit. Actually it is advised to keep several inches of ashes on the grates 29 at all times providing an insulation to the grates 29 from the heat of the coals.

It is further to be noted concerning the novel construction and design of the secondary combustion chamber 21, being of a flattend shape, all built inside of the heater magazine 14 and being it is in proximity with the primary and secondary combustion zone 10, will force it to operate at a higher temperature and at a longer length of time. This flattened design with the secondary air ports 23 and 36 and shelf 32 incorporated into the secondary combustion chamber 21, insures more complete combustion and less creosote formation.

It is futher to be noted, of the principles in the effect of the indirect primary draft. It is believed and proven, that such a system promotes the primary draft to flow through the charge of fuel in a more relaxed and natural state, encourageing the volatile to keep a balance with the capacity of secondary combustion. Also with indirect primary draft, confines the fire to the base of the fuel charge so that the fire cannot rise up into the full charge of fuel at once. Therefor it is much easier to control the rate of combustion, and there is a degree of inherent protection against uncontrolled overheating, providing the utmost in safety and carefree operation.

It is further to be noted the present invention allows full control of its operation and combustion without any other source of fuels or energy.

While I have described a preferred embodiment of my invention and preferred method for more complete combustion that fully satisfies the objects, aims and advantages set forth above, it is evident that many alternatives and various modifications of my invention can be made without departing from the principles thereof. Accordingly, it is intended to embrace all such alternatives and modification which fall within the scope and spirit of the appended claims.

I claim:

1. A stove comprising a body having a front wall, rear wall, top wall, base wall and parallel side walls;

a grate within said body spaced above said base wall to define an ash compartment below said grate and an upper secondary and lower primary combustion zones above said grate;

fuel inlet means and ash removal means;

an air inlet port located at the top edge of said rear wall and located between said side walls;

an air supply manifold in said body including a horizontal duct located along the intersection of said top and rear walls and communicating with said air inlet port and having two vertical ducts located along the intersection of said rear and side walls, the top ends of said vertical ducts in fluid communication with the ends of said horizontal duct, and the lower ends of said vertical ducts terminating above said grate and having outlet port means to direct air toward the grate and away from the rear wall;

a partition spaced from and parallel to said rear wall and attached at its side and top edges to the front of the vertical and horizontal ducts respectively and having a lower edge above said outlet port means, the distance between said rear wall and said partition being much less than the distance between said front wall and said partition, the space bounded by said partition, rear wall, vertical ducts and horizontal ducts forming a secondary combustion chamber having an entrance at its lower end in communication with said lower primary combustion zone;

an outlet means located below said air inlet means and in communication with said secondary combustion chamber and an exhaust flue conduit;

apertures in said manifold in fluid communication with said secondary combustion zone, the lower end of said secondary combustion chamber and the upper end of said secondary chamber near said outlet means.

2. A stove as described in claim 1 further including a bypass door located in said partition opposite said outlet means.

3. A stove as described in claim 1 further including a shelf located below said outlet means between said partition and said rear wall and having a width at least equal to the width of said outlet means.

4. A stove as described in claim 1 wherein said partition has a plurality of vertical ribs.

5. A stove as described in claim 1 wherein said fuel inlet means and said ash removal means each comprises a door and frame having a tapered mating flange.

* * * * *